US005482614A

United States Patent [19]

Kondo et al.

[11] Patent Number: 5,482,614

[45] Date of Patent: Jan. 9, 1996

[54] ELECTROLUMINESCENCE DISPLAY

[75] Inventors: Kenichi Kondo, Fujisawa; Takahiro Saida; Shuichi Taya, both of Yokohama; Toyoshi Iida, Tsukuba; Takeshi Sotomura, Tsukuba; Yuko Fujii, Tsukuba; Keiji Sato, Tsukuba; Mamoru Takahashi, Gunma; Sadayasu Yamakawa; Shunichi Osawa, both of Nagai, all of Japan

[73] Assignees: Stanley Electric Co., Ltd.; Japan Metals & Chemicals Co., Ltd., both of Tokyo, Japan

[21] Appl. No.: 283,776

[22] Filed: Aug. 1, 1994

Related U.S. Application Data

[62] Division of Ser. No. 812,577, Dec. 20, 1991, Pat. No. 5,359,261.

[30] Foreign Application Priority Data

| | | | |
|---|---|---|---|
| Dec. 28, 1990 | [JP] | Japan | 2-416782 |
| Jul. 25, 1991 | [JP] | Japan | 3-186335 |
| Oct. 11, 1991 | [JP] | Japan | 3-263749 |
| Oct. 15, 1991 | [JP] | Japan | 3-266485 |

[51] Int. Cl.[6] ..... C25D 11/16

[52] U.S. Cl. ..... 205/171; 205/203; 205/205; 205/206; 205/213; 205/219; 205/324

[58] Field of Search ..... 205/171, 199, 205/201, 203, 205, 206, 213, 219, 324

[56] References Cited

U.S. PATENT DOCUMENTS

| | | | |
|---|---|---|---|
| 4,204,919 | 5/1980 | Randall, Jr. et al. | 205/213 |
| 4,481,083 | 11/1984 | Ball et al. | 205/175 |
| 4,601,796 | 7/1986 | Powers et al. | 205/213 |
| 4,751,427 | 6/1988 | Barrow et al. | 313/509 |
| 4,777,402 | 10/1988 | Mitsumori | 313/509 |
| 4,849,672 | 7/1989 | Anderson, Sr. | 313/499 |
| 4,857,803 | 8/1989 | Anderson, Sr. | 313/509 |

FOREIGN PATENT DOCUMENTS

| | | |
|---|---|---|
| 0374050 | 6/1990 | European Pat. Off. . |
| 64-10597 | 1/1989 | Japan . |
| 1209693 | 8/1989 | Japan . |
| 1-209693 | 8/1989 | Japan . |
| 1225097 | 9/1989 | Japan . |
| 1-225097 | 9/1989 | Japan . |
| 3-196494 | 8/1991 | Japan . |
| 3-196493 | 8/1991 | Japan . |

OTHER PUBLICATIONS

Hubner, The Practical Anodising of Aluminum, 1960 (no month) pp. 21–23.

C. T. Chen; "Crystalline Anodic Oxide Growth on Aluminum Foil in an Aqueous Ammonium Dihydrogen Phosphate Anodization Electrolyte"; Jul. 1985; pp. 1567–1574.

D. J. Stirland; "Studies of the Structure of Anodic Oxide Films on Aluminum, I", Jun. 1959; pp. 481–485.

*Primary Examiner*—John Niebling
*Assistant Examiner*—Edna Wong
*Attorney, Agent, or Firm*—Frishauf, Holtz, Goodman, Langer & Chick

[57] ABSTRACT

An EL lamp having a higher luminescence efficiency and a process for manufacturing the same are provided. The EL element includes an aluminum foil having at least one specularly polished surface, an anodized oxide film formed on the specularly polished surface of the aluminum foil, a light emitting EL layer formed directly on the film, and a transparent electrode formed on the light emitting EL layer. The process for manufacturing an EL lamp includes the steps of polishing specularly at least one of the surfaces of an aluminum foil, forming an anodized oxide film on the specularly polished surface of the aluminum foil, and forming directly on the aluminum oxide film a light emitting EL layer and a transparent electrode.

24 Claims, 6 Drawing Sheets

ELECTROLUMINESCENCE DISPLAY

This is a division of application Ser. No. 07/812,577 filed Dec. 20, 1991, now U.S. Pat. No. 5,359,261, issued Oct. 25, 1994.

BACKGROUND OF THE INVENTION

1. Field of the Invention

The present invention relates to an EL (electrolumlnescence) lamp, and more particularly, to an EL lamp having a high luminescence efficiency adapted for use in liquid crystal displays (LCD) and the like, and a process for production of the same.

2. Description of the Related Art

Recently, electronic devices have been intensively required to be lightweight, of a thin type, and workable at low voltages, thereby consuming less electric energy (workable with any electric cells), and LCDs (liquid crystal displays) have been increasingly utilized as displays. Since LCDs themselves do not generate light, back up or back lights made of EL lamps have been used in order to improve visual perceptivity of LCDs.

Such light sources have been demanded to be of a thin form, lightweight and inexpensive. EL lamps can be made as thin plane luminescence sources having a lower power consumption as compared with, for example, luminescent discharge tubes and incandescent lamps. Especially, the demand of being "thinner" is more significant in double side light emitting EL lamps.

FIG. 10 is a schematic view of an example of the prior art EL elements. On back electrode 101 made of aluminum foil is formed insulating resin layer 107. This resin layer 107 may be produced by dissolving an organic resin having a high dielectric constant (referred to as binder hereunder) in a solvent, dispersing powdery barium titanate in the solution to produce an ink-like dispersion which is applied onto back electrode 101 by a printing method or the like and dried. On this insulating resin layer 107 are formed light emitting EL layer 103 and transparent electrode 104. Light emitting EL layer 103 may be produced by dispersing a phosphor powder in a similar binder as described above to produce an ink-like dispersion which is applied and then dried. Similarly, transparent electrode 104 may be produced by dispersing an ITO (indium tin oxide) powder in a similar binder to produce an ink-like dispersion which is applied and then dried. Leads 105 are attached to and extended from back electrode 101 and the transparent electrode 104, and the bulk body is packaged with a film having a high moisture-proofing property to complete an EL element.

Barium titanate has a high dielectric constant. Even with a barium titanate layer formed between electrodes, therefore, a reduction in voltage due to the barium titanate is small. For this reason, it is possible to apply a sufficient voltage onto the light emitting EL layer, whereby a higher brightness can be easily achieved.

In order to form a barium titanate layer on the surface of an aluminum layer, however, a coating step and the like must be conducted so that a reduction in the thickness of the insulating layer is limited. Moreover, there is a difficulty that uneven coating produced in the applying step may cause a so-called "repellence" or "repulsion" resulting in uneven luminescence.

In order to overcome such difficulties as above, an attempt has been proposed to coat the surface of the aluminum foil with an alumite film, by which the aforementioned barium titanate layer can be replaced.

Japanese Patent KOKAI (Laid-open) No. Sho 64-10597 discloses a field luminescence tube with an aluminum foil back electrode which was produced by anodizing an aluminum foil, one of the surfaces of which was subjected to an alumite forming treatment to produce an insulating layer.

Japanese Patent KOKAI (Laid-open) No. Hei 1-209693 discloses an aluminum laminate for use in dispersion-type electroluminescence panels comprising an aluminum foil having an alumite layer and a white coat layer formed thereon.

Japanese Patent KOKAI (Laid-open) No. Hei 1-225097 discloses a dispersion-type EL lamp comprising an aluminum foil, the surface of which is anodized to produce a porous oxide surface film.

These techniques employ as insulating layers an alumite film which is produced on the surface of an aluminum foil for the back electrode by subjecting the foil to alumite forming treatment.

The alumite film on the surface of an aluminum foil can be produced more inexpensively than the barium titanate insulating layers, is capable of producing EL elements having an equivalent luminescence efficiency and brightness. Moreover, the aluminum foil coated with alumite film is excellent in adhesion or binding property.

FIG. 11 shows a schematic view of one of the prior art double side light emitting EL elements. The double side light emitting EL lamp was fabricated by adhering the back sides of two identical single side light emitting EL elements with each other with a common electrode being disposed between and connected to both the back sides.

Each single side light emitting EL lamp comprises back electrode 110 of an aluminum foil having insulating resin layer 117 formed thereon. Insulating resin layer 117 may be produced by dissolving an organic resin having a high dielectric constant (referred to as binder hereafter) in a solvent, dispersing powdery barium titanate in the solution to produce an ink-like dispersion which is applied onto back electrode 110 by a printing method or the like and dried.

On insulating resin layer 117 are formed light-emitting EL layer 113 and transparent electrode 114. Light-emitting EL layer 113 may be similarly produced by dispersing a fluorescent powder in a binder and mixing to produce an ink-like dispersion which is applied onto insulating layer 117 by a printing method or the like and then dried.

Similarly, transparent electrode 114 may be produced by dispersing an IT0 (indium tin oxide) powder in a binder to produce an ink-like dispersion which is applied by a printing technique onto light emitting EL lamp 113 and then dried. Alternatively, a transparent electrode film comprising a polyester film having IT0 vapor-deposited may be used as transparent electrode 114.

Common electrode lead 115 is attached to and extended from both back electrodes 110, and electrode leads 116 are attached to and extended from transparent electrodes 114, respectively.

The main element body is packaged with a film having a high moisture-proofing property (not shown) to complete an EL element.

The alumite processing which has been also employed for a long time in treatment of the surfaces of aluminum sashes and aluminum foils is one of techniques of the forming porous films having a thickness of 6 μm to several hundred microns by conducting anodic oxidation in an acidic aqueous solution such as an aqueous solution of sulfuric acid.

The alumite layers produced by such techniques have a relatively low breakdown voltage or strength and exhibit a higher leakage current as the field intensity is increased. Therefore, the use of the alumite layers in EL elements may lower breakdown strengths of the elements, so that their luminescence efficiencies are not allowed to rise, because a higher electric field must be applied for increasing luminous intensity, if necessary.

SUMMARY OF THE INVENTION

It is an object of the present invention to provide an EL lamp having a stable insulating layer, a high emission efficiency and has reduced luminescence irregularity.

It is another object of the present invention to provide an extremely thin double side plane light emitting EL element.

In an aspect of the present invention, there is provided an EL lamp comprising an aluminum foil, anodized oxide film formed on the surface of the aluminum foil, a light emitting EL layer directly formed on the anodized oxide film, and a transparent electrode.

The aforementioned anodized oxide film should be preferably a barrier type film containing non-porous dense aluminum oxide produced on the surface of the aluminum foil by anodic oxidation. The barrier type film containing the non-porous dense aluminum oxide should be preferably one having hydrated oxide in the surface layer thereof.

Preferably the aluminum foil should have specularly ground surfaces.

In another aspect of the present invention, there is provided a double side light emitting EL lamp comprising a common back electrode layer of conductive material, insulating layers formed on opposing sides of said back electrode layer, respectively, light emitting EL layers formed on the outer surfaces of both said insulating layers, respectively, and transparent electrodes formed on the outer surfaces of both said EL layers, respectively.

In still another aspect of the present invention, there is provided a process for manufacturing an EL lamp comprising the steps of anodizing an aluminum foil in a neutral electrolyte at a voltage of 70 to 800 V to produce an anodized oxide film, and forming a light emitting EL layer directly on said anodized oxide film and then a transparent electrode layer on the external surface of said EL layer.

In still another aspect of the present invention, there is provided a process for manufacturing an EL lamp comprising the steps of immersing an aluminum foil in a pure water heated at a temperature of 50° C. or more, anodizing said aluminum foil in a neutral electrolyte to produce a barrier type film of non-porous dense oxide aluminum, and forming a light emitting EL layer directly on said barrier type film and then a transparent electrode on the external surface of said EL layer.

In still another aspect of the present invention, there is provided a process for manufacturing an EL lamp comprising the steps of grinding specularly the surfaces of an aluminum foil, producing an aluminum oxide film on said specularly ground surfaces of said aluminum foil, and forming a light emitting EL layer directly on said aluminum oxide film and then a transparent electrode on the external surface of said EL layer.

In still another aspect of the present invention, there is provided a process for manufacturing a double side light emitting EL lamp comprising the steps of forming insulating layers on the opposing surfaces of a conductive material, respectively, and forming light emitting EL layers on the outer surfaces of said insulating layers, respectively, and then transparent electrodes on the external surfaces of said EL layers, respectively.

Anodized oxide film can be readily produced on the surfaces of an aluminum foil. The step of producing oxide films by anodic oxidation is a more convenient and inexpensive step as compared with the step of coating an insulating resin layer.

Moreover, the anodic oxidation of the surfaces of aluminum foils permits uniform anodized oxide films throughout the surfaces of the foils to be readily formed, and the surfaces of the anodized oxide films are active. For this reason, difficulties such as the "repulsion" of the prior art can be avoided resulting in an increase in yield.

Particularly, the non-porous dense aluminum oxide films produced on the surfaces of aluminum foils by anodic oxidation have a higher insulating property than that of porous aluminum oxide films obtained by the alumite forming treatment. In addition, the non-porous dense aluminum oxide films can achieve a higher luminescence efficiency due to the high density.

The formation of hydrated aluminum oxide in the surface layer on the non-porous aluminum oxide film improves the wettability with the light emitting EL layer at the time of production of the same, whereby the repulsion can be removed and the irregularity of luminescence can be reduced.

The immersion of an aluminum foil in a pure water heated at a temperature of 50° C. or more produces hydrated aluminum oxide films having fluffs on the surfaces of the aluminum foil. The anodic oxidation of the aluminum foil with the thus produced hydrated oxide films in a neutral aqueous solution dehydrates gradually the hydrated oxide into crystalline oxide so that most of the amorphous $Al_2O_3$ on the surfaces of the aluminum foil is transformed to dense non-porous crystalline $Al_2O_3$ of the type of $\gamma$ and/or $\gamma'$ to produce a barrier type film.

Some of the hydrated oxide should remain in the form of a surface layer on the aluminum foil to improve the wettability of the foil with an EL layer at the time of production thereof and remove such repulsion as resulting in a reduction in luminescence irregularity.

Moreover, before the oxide film is formed on the surface of the aluminum foil, the surface should be ground into a specular surface to improve at least one of brightness and luminescence efficiency.

It has been found that the ground aluminum foil has a reduced electrostatic capacity as compared with that of untreated aluminum foil. Particularly, excellent results have been obtained with the aluminum foil having an electrostatic capacity of less than 300 $\mu F/dm^2$.

After the specularly ground aluminum foil was anodized, the foil may be subjected to hydration treatment in a boiling pure water to increase a brightness and a luminescence efficiency as well as an ability preventing the repulsion.

The use of the opposing surfaces of a conductive layer as a common back electrode avoids the need of superimposing two back electrodes so that the whole double side light emitting EL element can be made thinner, allowing the production process to be simplified.

Furthermore, the insulating layers of a double side light emitting EL lamp should be made by anodizing the back electrode comprising an aluminum foil to make the insulating layers thinner so that the resultant EL lamp can be thinner as a whole.

DESCRIPTION OF PREFERRED EMBODIMENTS

Figure 1:
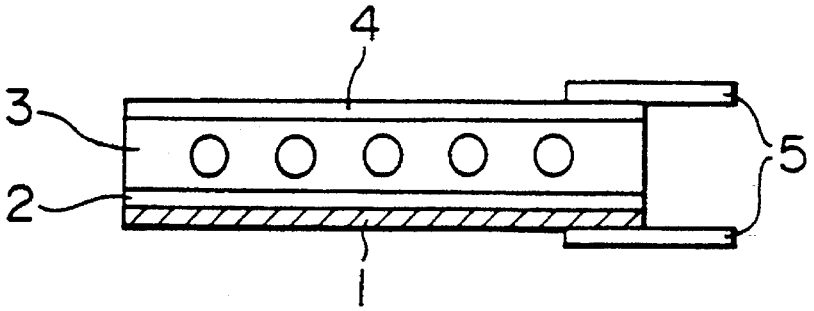
FIG. 1 is a schematic cross-sectional view of the EL element fabricated as in Example 1.

FIG. 1 shows a schematic cross-sectional view of the EL lamp according to an Example of the present invention. Anodized oxide film 2 is formed on the surface of back electrode 1 comprising an aluminum foil. On the anodized oxide film 2 is produced light emitting EL layer 3, on which transparent electrode 4 is formed. Leads 5 extend from back electrode 1 and transparent electrode 4, respectively. The bulk EL lamp is packaged with a highly moisture-proofing film.

A step of forming anodized oxide film 2 on the surface of aluminum foil 1 will be explained hereunder.

An aqueous solution of ammonium borate having a concentration of 0.2 mol/l was used an electrolyte and an aluminum foil having a purity of 99.99% was used for the anode and cathode. Electrolysis was performed at a cell temperature of 60° C., at a current density of 0.45 A/dm$^2$. Values of voltage set up and descending current after the voltage was in a steady state were varied as indicated in Table 1 hereunder. In this way, a barrier type anodized oxide film was produced on the surface of the aluminum foil. The aluminum foil having the anodized oxide film was used to fabricate EL elements.

On top of the anodized oxide film formed on the aluminum foil is directly produced light emitting EL layer 3 and then transparent electrode 4. For example, fluorescent particles are dispersed in a binder having a high dielectric constant such as cyanoethylated 4-4-6 triglucan, cyanoethylated polyvinyl alcohol, and the like, and dissolved in a solvent such as DMF (dimethylformamide) and the like to produce an ink-like dispersion which is applied onto the surface of the anodized oxide film, and dried to form light emitting EL layer 3.

Then ITO particles are dispersed into a solvent such as DMF (dimethylformamide) and the like together with cyanoethylated polyvinyl alcohol to form an ink-like dispersion which is applied on top of the light emitting EL layer, and dried to produce transparent electrode 4.

Thereafter, leads 5 are attached to and extended from aluminum foil 1, i.e., the back electrode, and transparent electrode 4, respectively, to complete such arrangement as shown in FIG. 1. If necessary, the bulk EL lamp may be packaged with a moisture-proofing film.

The results obtained by evaluating the EL elements fabricated as above for brightness and luminescence efficiency are given in Table 1.

TABLE 1

| | Conditions for foil preparation and characteristics of EL elements | | | | |
|---|---|---|---|---|---|
| No. | Voltage | Current | Thickness of film | Brightness of EL lamp | Luminescence efficiency |
| 1 | 140 V | 450 mA/dm$^2$ | 0.15 μm | 63 cd/m$^2$ | 1.31 1 m/W |
| 2 | | 100 mA/dm$^2$ | | 62 cd/m$^2$ | 1.21 1 m/W |
| 3 | | 10 mA/dm$^2$ | | 63 cd/m$^2$ | 1.21 1 m/W |
| 4 | 180 V | 450 mA/dm$^2$ | 0.20 μm | 65 cd/m$^2$ | 1.61 1 m/W |
| 5 | | 100 mA/dm$^2$ | | 60 cd/m$^2$ | 2.01 1 m/W |
| 6 | | 10 mA/dm$^2$ | | 61 cd/m$^2$ | 2.01 1 m/W |
| 7 | 220 V | 450 mA/dm$^2$ | 0.28 μm | 58 cd/m$^2$ | 2.41 1 m/W |
| 8 | | 100 mA/dm$^2$ | | 57 cd/m$^2$ | 2.51 1 m/W |
| 9 | | 10 mA/dm$^2$ | | 57 cd/m$^2$ | 2.51 1 m/W |
| 10 | 260 V | 450 mA/dm$^2$ | 0.35 μm | 57 cd/m$^2$ | 2.71 1 m/W |
| 11 | | 100 mA/dm$^2$ | | 57 cd/m$^2$ | 2.71 1 m/W |
| 12 | | 10 mA/dm$^2$ | | 56 cd/m$^2$ | 2.71 1 m/W |
| 13 | 300 V | 450 mA/dm$^2$ | 0.45 μm | 54 cd/m$^2$ | 2.81 1 m/W |
| 14 | | 100 mA/dm$^2$ | | 52 cd/m$^2$ | 2.81 1 m/W |
| 15 | | 10 mA/dm$^2$ | | 50 cd/m$^2$ | 2.71 1 m/W |

Voltage: Desired voltage.
Current: Value of descending current after the voltage was in a steady state.

Figure 2:
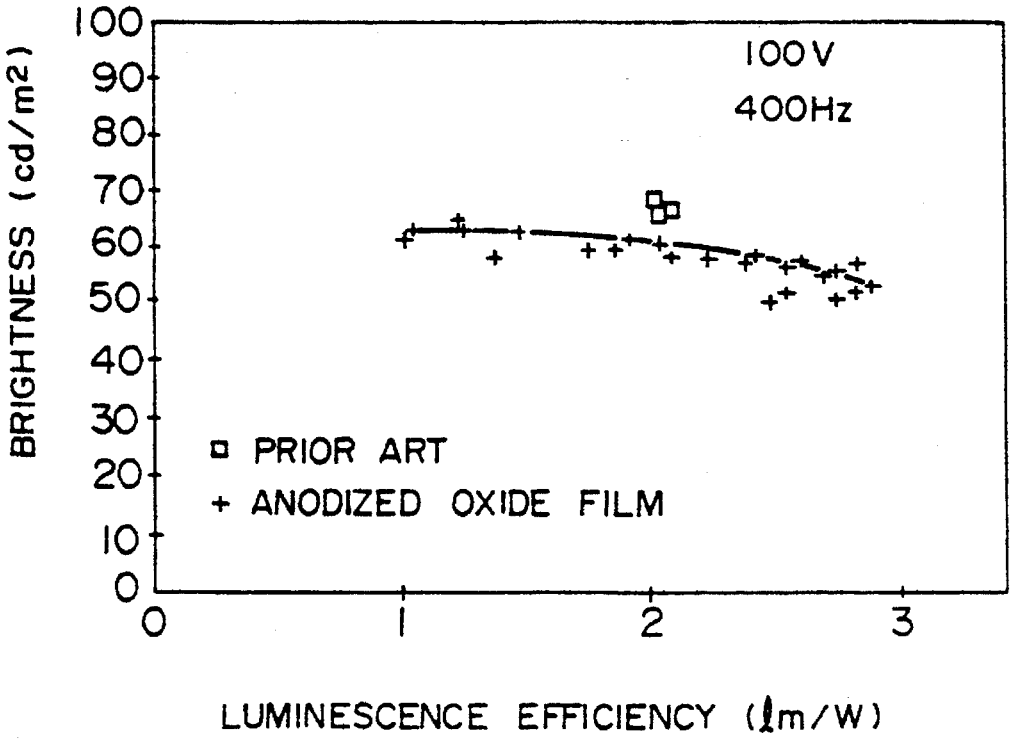
FIG. 2 is a graph showing the characteristics of brightness vs. luminescence efficiency of the EL lamp fabricated according to an embodiment of the present invention and those of the prior art.

Relations between the luminescence or emission efficiency and the brightness are plotted in a graph of FIG. 2. Drive of EL lamps were done at 100 V and 400 Hz.

Preferable results were obtained when the anodic oxidization process was performed in neutral borate based electrolyte solution under the conditions of current density of 0.1 A/dm$^2$, descended current density after transition to a stabilized voltage of 10 mA/dm$^2$–5 A/dm$^2$, and electrolyte bath temperature of 20°–90° C.

For the purpose of comparison, characteristics of EL lamps using a resin insulator layer according to the prior art formed by dispersing barium titanate powder in binder were also measured and plotted in FIG. 2. The prior art EL lamp showed characteristics of the order of brightness of 65 cd/m$^2$ and efficiency 2.0 lm/W under a drive of 100 V and 400 Hz. EL lamps formed by using an anodic oxdization film showed characteristics near those of this prior art EL lamp, but distributed in a wider luminescence efficiency range.

According to the above embodiment, similar characteristics as those of prior art EL lamps made through a coating step can be obtained without the step of coating for forming an insulator layer. Formation of an anodic oxidation film requires less cast of raw material, less man power and can reduce the manufacturing cost, compared to the coating of an insulator layer.

The anodized aluminum oxide films do not produce such unevenness as the "repulsion" or "repellence" which may occur otherwise in application of the ink-like insulating material. Controlling the step of the anodic oxidation allows a uniform anodized oxide film to be readily produced all over the surface of the aluminum foil. In the prior art, occurrence of the "repulsion" lead to the formation of dark sites of 1 to 3 mmϕ in the resultant EL elements which were failed products in applications as back lights for LCD display elements and the like, thereby causing a reduction in the yield. The use of the anodized oxide film can reduce such failures to improve the yield.

The insulating layers produced by the coating process require generally a thickness of 20 to 40 μm, while the anodized oxide film can have sufficient insulating properties even with their thickness being 1 μm or less. For this reason, it becomes possible to fabricate thinner and more light weight EL elements.

Variation in parameters of the steps of producing the anodized oxide films can vary the characteristics of the EL elements fabricated. For example, EL elements can be manufactured to have a higher luminescence efficiency with only a slight reduction in brightness.

EXAMPLE 2

Figure 3:
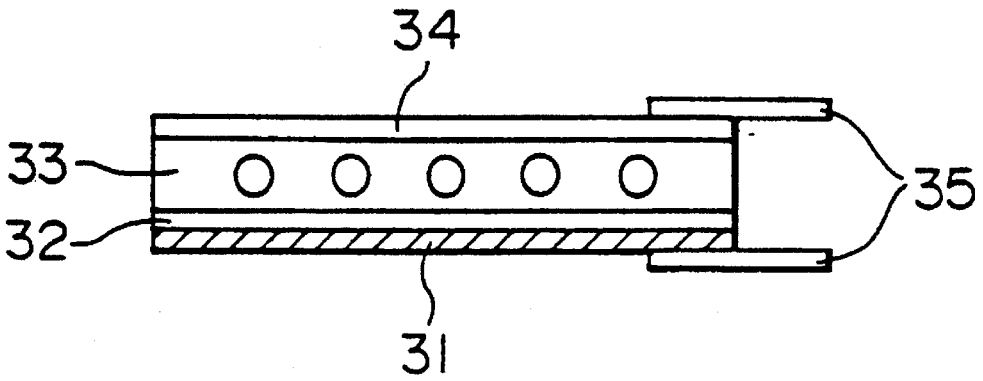
FIG. 3 is a schematic cross-sectional view of the EL element according to an embodiment of the present invention.

FIG. 3 shows a schematic view of the EL lamp according to an embodiment of the present invention. On the surface of back electrode 31 comprising an aluminum layer of an aluminum foil or the like is formed non-porous dense crystalline $Al_2O_3$ film 32 through anodic oxidation.

Non-porous dense crystalline $Al_2O_3$ film 32 is provided on the top thereof with light emitting EL layer 33, on which transparent electrode 34 is formed. Back electrode 31 and transparent electrode 34 have leads 35 extending therefrom, respectively. The bulk EL lamp is packaged with, for example, a highly moisture-proofing film.

For example, back electrode 31 is made of an aluminum foil having a thickness of about 80 μm, on the surface of which non-porous dense crystalline $Al_2O_3$ film 32 having a thickness of about 0.01 to 0.45 μm is formed. This non-porous dense $Al_2O_3$ film 32 comprises γ-, or γ-type alumina, or a mixture of both.

Preferably, on the surface of the non-porous dense $Al_2O_3$ film should be formed a thin hydrated oxide film.

A process for producing non-porous dense $Al_2O_3$ film 32 on the surface of aluminum foil 1 will be explained under.

A prepared aluminum foil is immersed in a distilled water heated at a temperature of 50° C. or more, preferably 90° C. or higher. On the surface of the aluminum which has been immersed in the distilled water is produced a hydrated aluminum oxide layer having fluffs. It will be apparent that ion-exchanged water or other pure water may be used instead of distilled water.

The distilled water may be added with phosphoric acid or phosphates in a concentration of 1 ppm to 100 ppm. The addition of phosphoric acid or phosphorate can remove irregularity in hydration allowing production of EL elements having a higher brightness.

Activators such as Mn or rare earth elements, for example, Eu, Tb, Nd, Dy and the like may be added to the distilled water. These activators disperse uniformly throughout the resultant film resulting in enhancement in the brightness of EL elements.

The aluminum foil having hydrated oxide formed on the surface thereof is anodized in a neutral aqueous solution of inorganic or organic salts such as aqueous ammonium borate based solutions, aqueous ammonium phosphate based solutions, and aqueous ammonium adipate based solutions of pH 5 to 8.

The anodic oxidation dehydrates gradually the oxide hydrate, and as a result, most of the amorphous $Al_2O_3$ on the surface of the aluminum foil transforms into the γ- and/or γ'-type of non-porous dense crystalline Al2O3 resulting in the formation of the barrier type film.

It is important to note that when the anodic oxidation is conducted without the hydration treatment, or the anodic oxidation is conducted in an aqueous acidic solution even with the hydration treatment, the aforementioned barrier type film can not be obtained.

Therefore, it is necessary that first the hydration treatment is carried out, and subsequently the anodic oxidation is performed in a neutral aqueous solution.

Preferably, on the surface of the barrier type film should remain oxide hydrate in the form of a very thin layer of 0.1 μm to 0.5 μm.

Such hydrated oxide on the surface of the anodized oxide film enhances the wettability of the surface with a binder at the time of producing the EL layer and eliminates the repulsion, which are effective to remove the irregularity in luminescence.

As described above, the step of immersing the aluminum foil in a distilled water at 50° C. or more is to form the hydrated oxide film which permits the non-porous dense crystalline $Al_2O_3$ of the γ- and/or γ'-type having residual oxide hydrate in the very thin layer to be formed on the foil in the subsequent anodic oxidation step.

The γ- (or γ'-) type alumina fine crystals produced from dehydration of pseudo-boehmite crystals are sealed into the barrier film growing under the anodic oxidation to act as nuclei for the transformation from the amorphous to the γ- and/or γ'-alumina.

The aluminum oxide is produced from both the interface between an aluminum substrate and an oxide film and that between the oxide film and an electrolyte. The crystalline oxide layer produced is of the dense barrier type which has a prominent breakdown strength, a higher electrostatic capacity and is not prone to fracture even under overvoltages.

The current density for the anodic oxidation should be preferably in the range of 0.1 to 5 $A/dm^2$, and after the voltage reaches the steady state, the descended current should be preferably 0.01 to 5 $A/dm^2$. The electrolyte cell should be preferably at a temperature from room temperature up to 90° C. However, these conditions are not critical.

The reason why the electrolysis is conducted in a neutral electrolyte lies in the formation of a dense barrier type film. In contrast, the electrolysis conducted in an acidic electrolyte as conducted in alumite forming treatment produces a porous oxide film. The formation of the non-porous dense film of the barrier type enables the production of EL elements having a higher breakdown strength and a higher luminescence efficiency.

The barrier type film should have preferably a thickness of about 0.01 to 0.45 μm. The thickness of over 0.45 μm may result in a greater reduction in voltage across the barrier type film with a reduction in brightness. The thickness of lower than 0.01 may cause a reduction in breakdown strength.

Also, the hydration treatment can be performed after anodic oxidation. By the hydration posterior to the anodic oxidation, characteristics of the EL lamp may be imposed such that prevention of repellence may be increased.

As previously described, on the surface of the aluminum foil having the barrier type film formed is directly produced a light emitting EL layer and a transparent electrode.

For example, a phosphor powder is dispersed in a binder such as cyanoethylated 4-4-6 triglucan or cyanoethylated polyvinyl alcohol and added with a solvent such as DMF (dimethylformamide) to produce an ink-like dispersion which is applied on the barrier type film. The applied layer is dried to complete the light emitting EL layer.

To a powdery ITO are added a solvent such as DMF and the like with cyanoethylated 4-4-6 triglucan to produce an ink-like dispersion for transparent electrode which is applied on the light emitting EL layer and then dried.

The thus fabricated structure is provided with means for applying voltages. For example, leads are attached to and extended from the aluminum foil back electrode and the transparent electrode to arrange the structure as shown in FIG. 1. Moreover, the bulk EL lamp is packaged with a moisture-proofing film.

As a transparent electrode layer, a film comprising a polyester film having ITO vapor-deposited on the surface thereof may be used.

According to the foregoing Examples, characteristics equal to or better than those obtained by coating techniques without using any coating step for the formation of the insulating layer. The film formation by anodic oxidation allows reductions in cost of requisite materials and time consumption as well as in production cost as compared with those by the coating techniques for producing the insulating layer.

The provision of the non-porous dense aluminum oxide layer allows a drastic increase in breakdown strength and an enhancement in luminescence efficiency due to reduction in leak current.

Examples of manufacturing EL elements according to the embodiment as described above will be provided hereunder.

A number of sheets of aluminum foil having a purity of 99.99 were prepared. The aluminum foils were immersed in a boiling distilled water with or without 10 ppm of phosphoric acid for about 5 minutes to produce about 0.3 μm of aluminum oxide hydrate on the surfaces thereof.

Anodic oxidation was performed in an aqueous ammonium borate solution with the aluminum foils being used as an anode and cathode. The conditions for the anodic oxidation were as follows: concentration of ammonium borate, about 0.2 mol/l; applied voltage, about 250 V; current density, about 0.8 A/dm$^2$.

In the manner as above, were formed non-porous dense crystalline $Al_2O_3$ oxide layers of a thickness of about 0.3 μm having hydrated aluminum oxide of a thickness of about 0.1 μm remained in the surface layer.

The thus prepared aluminum foil having an insulating layer was provided on its surface with a light emitting layer and a transparent electrode of a transparent conductive film in order. The characteristics of the EL elements manufactured in this way are given in Table 2.

TABLE 2

| Sample | Brightness (cd/m$^2$) | Luminescence efficiency (Lm/W) |
|---|---|---|
| Barium titanate | 65.0 | 6.15 |
| Barrier type film | 60.9 | 6.46 |
| Boiled in water | 62.1 | 6.87 |
| Boiled in diluted phosphoric acid | 66.6 | 6.71 |
| Added with Mn | 66.2 | 6.50 |
| Boiled after anodization | 67.0 | 6.90 |

In Table 2, The sample of barium titanate indicated as the first Example in the Table is according to the prior art, while other samples indicated as the second Example et seq., are of the barrier type manufactured according to an embodiment of the present invention. The term "boiled" refers to those anodized after the boiling.

It has been confirmed that the EL elements manufactured according to the present invention are all excellent in luminescence efficiency, do not suffer from any repulsion, and are not susceptible to breakdown of the insulating layer even under an overvoltage.

As a result of X-ray diffraction analysis, it has been confirmed that the film formed on the surfaces of the aluminum foil includes a hydrated oxide of boehmite and an Al2O3 layer of γ- or γ'-type aluminum oxide.

EXAMPLE 3

Figure 4:
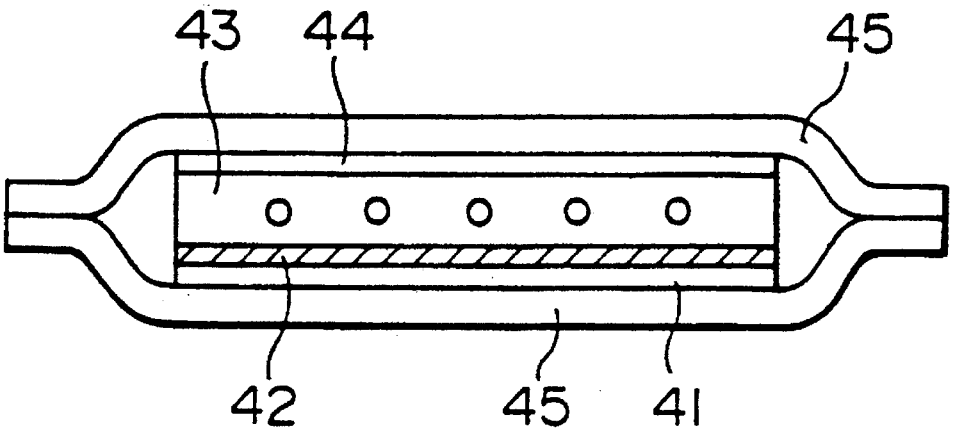
FIG. 4 is a schematic cross-sectional view of the EL element according to another embodiment of the present invention.

FIG. 4 shows a schematic view of the EL lamp fabricated in the Example. On the surface of back electrode 41 is formed insulating layer 42 of aluminum oxide ($Al_2O_3$) film produced by anodic oxidation.

This insulating layer 42 can be produced by subjecting the surfaces of an aluminum foil to electrolytic polishing, chemical polishing, or mechanical grinding to produce specular surfaces followed by anodic oxidation.

On the aluminum oxide insulating layer 42 is formed light emitting EL layer 43 and transparent electrode 44. Light emitting EL layer 43 is produced by mixing a fluorescent material and an organic resin having a high dielectric constant (binder) such as cyanoethylated 4-4-6 triglucan and the like with a solvent to produce an ink-like dispersion which is applied by a printing technique onto insulating layer 42 and dried.

Transparent electrode 44 may be similarly produced by dispersing an ITO (indium tin oxide) powder in a binder and dissolving with a solvent to produce an ink-like dispersion which is applied onto light emitting EL layer 43 and then dried. Alternatively, as transparent electrode 44 a transparent electrode film comprising a polyester film having ITO vapor-deposited thereon may be used.

Leads (not shown) are attached to and extended from back electrode 41 and transparent electrode 44, respectively. The main element body is packaged with a film having a high moisture-proofing property 45 to complete an EL lamp.

For example, back electrode 41 is made of an aluminum foil having a thickness of about 80 μm, on the surface of which the aluminum oxide ($Al_2O_3$) film having a thickness of about 0.01 to 0.45 μm is formed.

Now a process of creating specular surfaces on an aluminum foil by subjecting the foil to electrolytic polishing, chemical polishing, or mechanical grinding below.

Electrolytic polishing

There was prepared an aluminum foil of a purity of 99.99 or more which was subjected to electrolytic treatment in an electrolyte solution of 150 g of sodium carbonate and 50 g of sodium phosphate in one liter of pure water at a current density of 12 A/dm$^2$ at an electrolyte temperature of 90° C. for two minutes with the foil being used as a anode and a carbon plate as a cathode. The resultant aluminum foil had a surface electrostatic capacity of about 260 μF/dm$^2$. This treatment produced a quite thin oxide film on the order of 0.01 μm containing aluminum phosphate on the surfaces.

Chemical polishing

Chemical polishing for production of specular surfaces may be performed by immersing an aluminum foil of a purity of 99.99 or more in a solution containing 80% phosphoric acid, 5% nitric acid, 14.5% acetic acid and 0.5% copper nitrate maintained at a temperature of 100° C. for about one minute.

Mechanical polishing

Aluminum material is cast into an ingot of dimensions of 1 m×30 cm×1.5 m and a weight of about 1.2 t which is homogenized by maintaining at high temperatures for a long time and ground on the surfaces to remove stains and impurities.

The ingot is heated at 500° C. and then hot rolled. About ten times of passing produce an aluminum plate having a thickness of about 3 to 5 mm and grain size of about 0.5 mm.

Then, with a high accuracy rolling machine the aluminum plate is cold rolled into an aluminum foil having a thickness of about 80 μm, during which the temperature is maintained at a predetermined level and a rolling oil is applied to create specular surfaces.

Furthermore, the specular surfaces of the aluminum foil are washed to remove oils from the surfaces, and thereafter annealed by heat-treatment to be softened.

In the next place, a step for producing insulating layer 42 of aluminum oxide film by anodizing the aluminum foil having specular surfaces prepared by any one of the techniques as described above will be illustrated.

In the case of electrolytic polishing, such treatment itself may produce oxide films on the surfaces, which oxide films may be used as such.

Non-porous barrier type film

In order to obtain films excellent in breakdown strength and the like as oxide films, preferably they should be of a non-porous barrier type.

The specularly polished aluminum foils were anodized by conducting anodic oxidation in a neutral electrolyte of an aqueous 0.2 mol/l ammonium borate solution at a temperature of about 60° C. at a constant current density of 0.8 $A/dm^2$ under rising voltage, and after the voltage reached 250 V, at a constant voltage thereof until the current density reached 1/10 or less with the foils being used as an anode and an aluminum plate having a purity of 99.99% as a cathode. This produced non-porous dense crystalline $Al_2O_3$ films.

The reason why the electrolysis is conducted in such a neutral electrolyte lies is the formation of dense barrier type film. An electrolysis conducted in an acidic electrolyte as in alumite forming treatment produces a porous oxide film. The formation of the non-porous dense film of the barrier type enables the production of EL elements having a higher breakdown strength and an excellent luminescence efficiency.

The barrier type film should have preferably a thickness of about 0.01 to 0.45 μm. The thickness of over 0.45 μm may result in a greater reduction in voltage across the barrier type film with a reduction in brightness.

As previously described, on the surface of the aluminum foil having the barrier type film formed is directly produced a light emitting EL layer and a transparent electrode.

The formation of hydrated oxide in the surface layer on the non-porous aluminum oxide film improves the wettability with the light emitting EL layer at the time of production of the same, whereby the repulsion can be removed and the irregularity of luminescence can be reduced. One of techniques of producing the hydrated oxide layer is to immerse the aluminum foil in a pure water heated at a temperature of 50° C. or more.

The anodic oxidation of the aluminum foil with the thus produced hydrated oxide layer in a neutral aqueous solution dehydrates gradually the hydrated oxide into crystalline oxide so that most of the amorphous $Al_2O_3$ on the surfaces of the aluminum foil is transformed to dense non-porous crystalline $Al_2O_3$ of the $\gamma$ and/or $\gamma'$ type resulting in the barrier type film.

Some of the hydrated oxide should remain on the surfaces of the aluminum foil to improve the wettability of the foil with a binder at the time of production of EL elements, thereby allowing removal of the repulsion and reduction in luminescence irregularity.

The materials for electrolytes, temperatures, concentrations, treating times, voltages, and currents described in Examples above are not critical. It should be understood as a matter of course that other equivalent conditions and processes may be employed for production of the aluminum oxide films through anodic oxidation after creating specular surfaces on the aluminum foils within the scope of the present invention.

Although the reasons why the specular surfaces obtained by chemical polishing, electrolytic polishing, or mechanical grinding contribute to enhancements in brightness and luminescence efficiency still remain to be clarified for further investigation, it may be speculated that the irregular configuration of the surfaces of the aluminum foil is smoothed by specularly polishing to improve the conditions of the intersurface in contact with phosphor powder resulting in increases in magnitude of field strength applied to the phosphor powder and an amount of electrons to be injected.

Figure 5A:
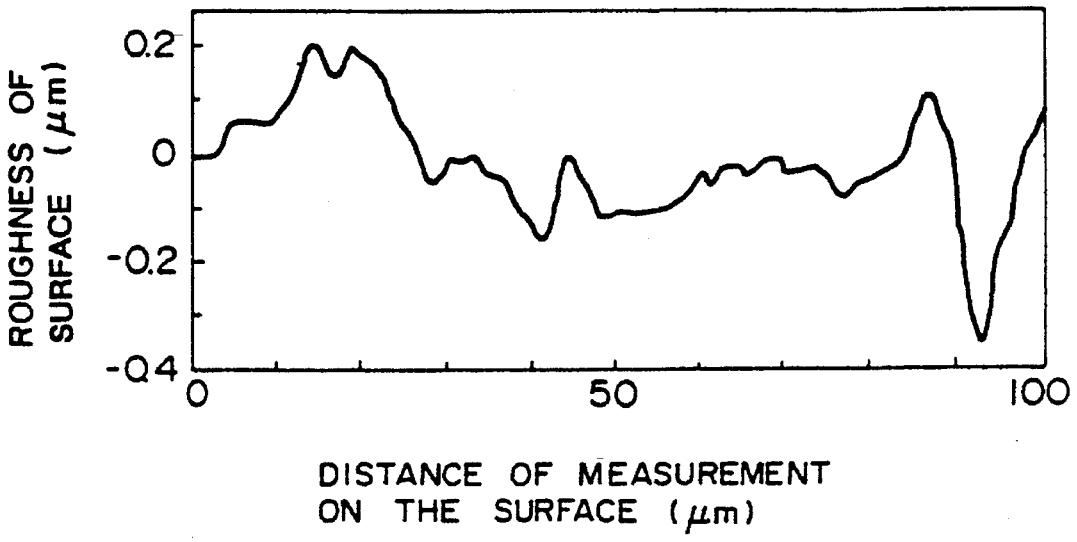
FIGS. 5(A) and 5(B) are graphs showing a comparison of the roughness of a polished surface with that of the untreated surface.
Figure 5B:
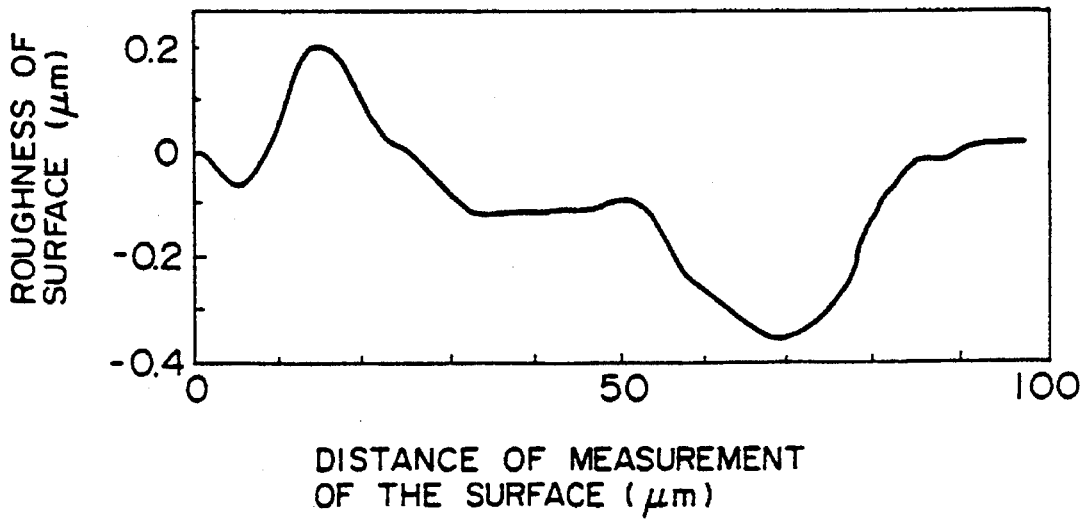

FIGS. 5(A) and 5(B) show a comparison of the roughness of the surfaces of the chemically polished aluminum foil with that of untreated aluminum foil. FIG. 5(A) shows the roughness of the surfaces of untreated aluminum foil where small and large irregularities are present in a mixed state. FIG. 5(B) shows the roughness of the surfaces of the chemically polished aluminum foil where the small irregularities as present in the untreated foil are removed.

Consequently, the surfaces are smoothed. The electrolytic polishing is considered to provide almost identical surfaces. The mechanical grinding has a little different mechanism, but is considered similarly capable of reducing the irregularities.

On the insulating layer formed by anodic oxidation as described above is formed a light emitting EL layer by mixing a phosphor powder and cyanoethylated 4-4-6 triglucan with DMF (dimethylformamide) as solvent to produce an ink-like dispersion which is applied by a printing technique onto the insulating layer and dried.

A transparent electrode film comprising a polyester film having ITO vapor-deposited thereon is adhered onto the light emitting by hot pressing and leads (not shown) are attached to the back electrode and transparent electrode, respectively. The whole body is packaged with a film having a moisture-proofing property to complete an EL lamp.

Figure 6:
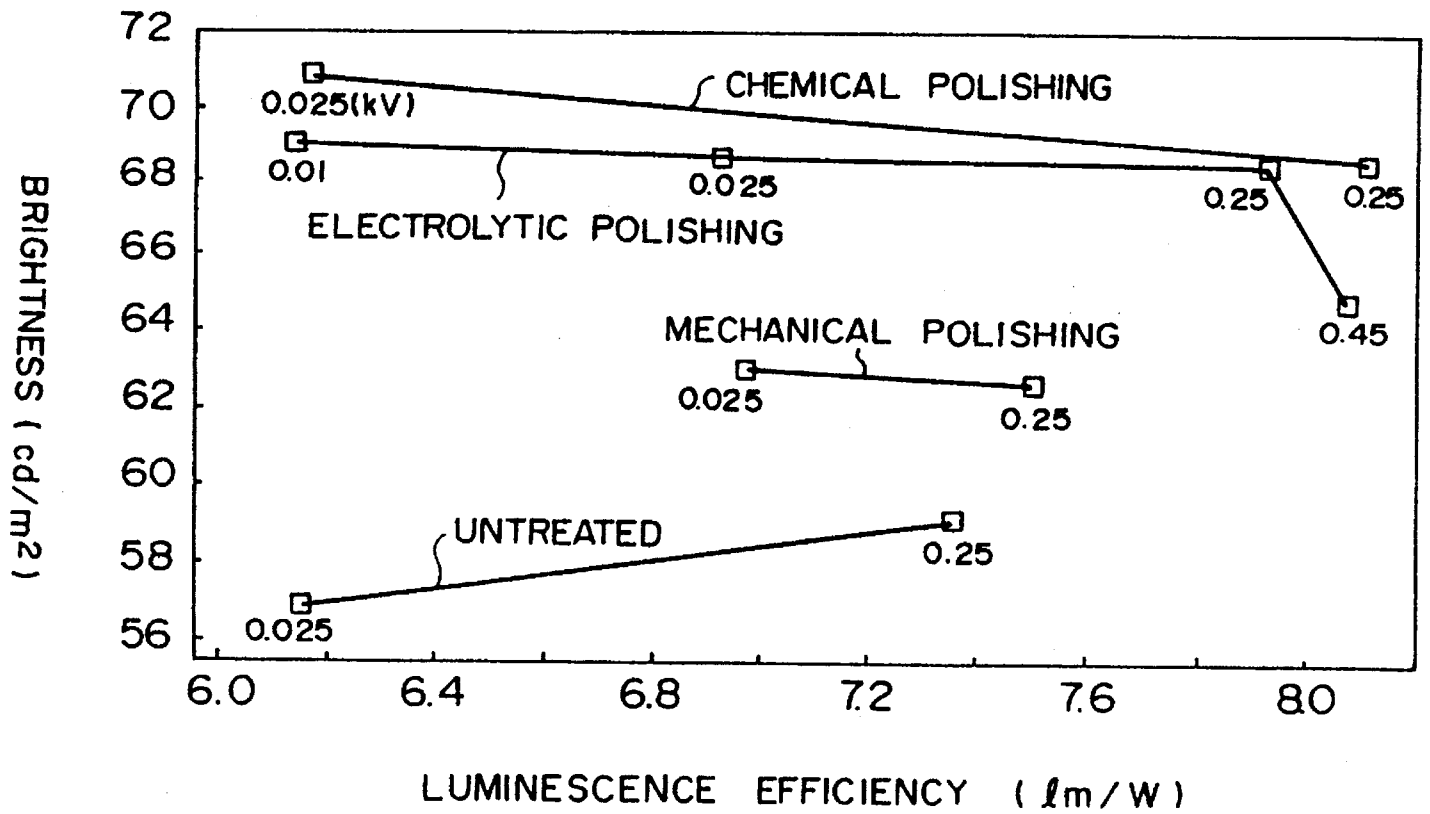
FIG. 6 is a graph showing the brightness and luminescence efficiency data for various EL lamps treated according to the embodiments of this invention.

The characteristics of the EL lamp manufactured by the process including the specularly polishing step as described above with those of an EL lamp by the same process except that the specularly polishing step was not effected are compared in Table 3 and FIG. 6 where the ordinate represents the brightness and the abscissa represents the luminescence efficiency when the barrier films were produced on various substrates by electrolysis in a neutral electrolyte at a constant voltage of 25 V or 250 V. Referential numbers in the FIG. 6 designate the thickness (μm) of the barrier layer. FIG. 6 shows the results of an anodic oxidation A1 test at 100 volts, 400 Hz, for products having a film polished prior to chemical treatment.

The untreated foil means a foil produced by a procedure including dispersing an ordinary barium titanate powder in an organic binder and subjecting to hairline processing in order to increase adhesiveness to a thick film EL lamp at the time of production thereof by coating.

Compared with the untreated substrates, both the luminescence efficiency and the brightness become increasingly higher in the order of mechanical grinding, electrolytic polishing, and chemical polishing. Particularly, it can be noted that the electrolytically polished or chemically polished substrates having the barrier type film are excellent.

Since the area in contact with phosphor powders depends upon the roughness of the surfaces, capacity reflecting the roughness was determined (wet determination of capacity).

The conditions for determination of capacity were as follows:

1. Pretreatment

Treatment with phosphoric acid-chromic acid to remove oxides on the surfaces followed by washing with water, and drying at 100° C. for 5 minutes (Treatment with phosphoric acid-chromic acid; 700 ml of 85% phosphoric acid+chromic acid of 40 g/l, 85° C., immersion for one minute).

2. Capacity determination

| | |
|---|---|
| Measuring solution | ammonium borate 30 g/l |
| Cathode | carbon plate |
| Electrode spacing | 3 cm |
| Measuring temperature | 26° C. |
| Measuring time | one minute after immersing a foil in the solution |
| Measuring frequency | 400 Hz |
| Measuring signal level | 0.5 Vrms |
| Measuring apparatus | HP-4194A Impedance Analyzer |

TABLE 3

| | | No anodized oxide film | | Anodized oxide film (0.25 μm) | |
|---|---|---|---|---|---|
| Type of foil | Capacity (μF/dm2) | Brightness | Efficiency | Brightness | Efficiency |
| Untreated | 406(402,404, | 59.3 | 4.92 | 59.0 | 7.35 |
| Mechanically polished | 286(284,280, 295) | 64.7 | 5.40 | 62.6 | 7.51 |
| Chemically polished | 261(258,266, 258) | 67.1 | 6.43 | 68.6 | 8.11 |
| Electrolytically Polished(11A) | 263(263,258, 265,267) | 70.2 | 5.46 | 68.6 | 7.93 |
| Electrolytically Polished(5A) | 247(257,257) | 71.8 | 5.46 | 67.4 | 8.03 |
| Electrolytically Polished(3.5A) | 261(264,257) | 68.1 | 5.99 | 63.7 | 8.07 |

The elements with the untreated foils exhibited a capacity of 400 $\mu F/dm^2$ or more, whereas those with any one of the polished ones had a capacity as low as 300 $\mu F/dm^2$ or less. Especially, those with the chemically polished or electrolytically polished foils had a capacity as low as around 260 $\mu F/dm^2$. Moreover, there has been noted a tendency that the elements with foils having a lower capacity exhibited a higher brightness and a higher efficiency.

It can be seen from the above results that the polishing should be preferably made to achieve a capacity of 300 $\mu F/dm^2$ or less.

From the foregoing measurement results, the following facts have been found. That is, the elements with specularly polished foils have a brightness and a luminescence efficiency about 10 to 20% higher than those of the elements with conventional aluminum foils so that creation of specular surfaces of aluminum substrates allows improvement of characteristics of the elements.

Figure 7:
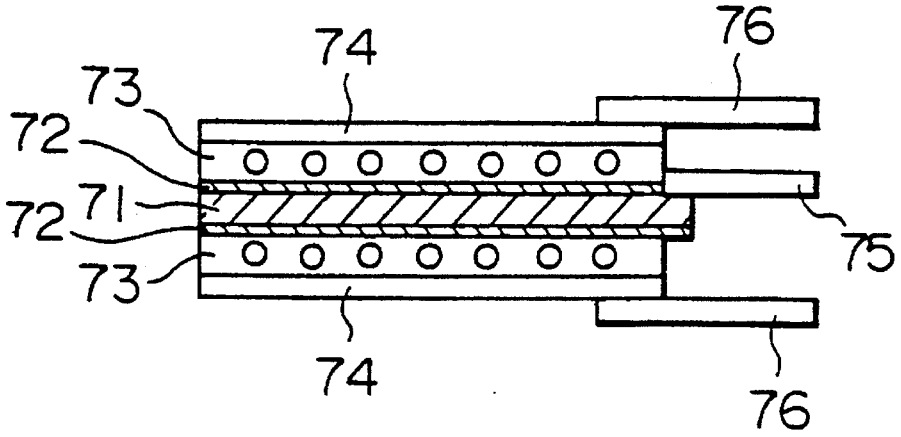
FIG. 7 is a schematic cross-sectional view of the double side light emitting EL lamp according to an embodiment of the present invention.
Figure 8:
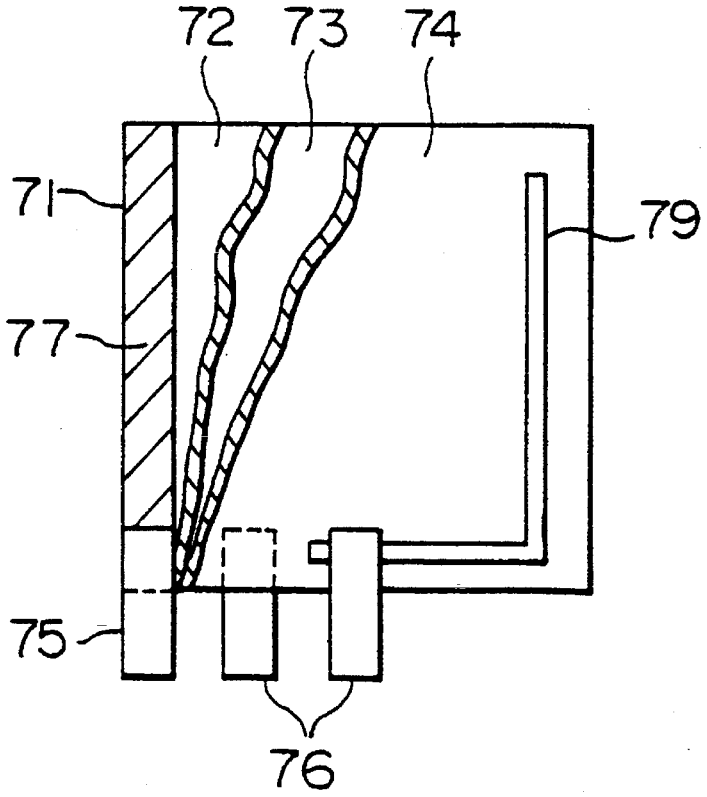
FIG. 8 is a schematic view of the double side light emitting EL lamp according to an embodiment of the present invention.

FIGS. 7 and 8 show schematic views of the double side light emitting EL lamp according to an embodiment of the present invention. On the opposing surfaces of common back electrode 71 are formed insulating layers 72 of aluminum oxide ($Al_2O_3$) film produced by anodic oxidation, respectively.

These insulating layers 72 are produced by subjecting the opposing surfaces of an aluminum foil to anodic oxidation in a neutral electrolyte solution to form barrier type aluminum oxide films on the surfaces.

The barrier type aluminum oxide films are preferably of non-porous dense $Al_2O_3$ and may be produced in the same steps as those described above.

On the outer surface of each aluminum oxide insulating layer 72 is formed light emitting EL layer 73 and transparent electrode 74. Light emitting EL layer 73 is produced by mixing a phosphor powder and an organic resin having a high dielectric constant such as cyanoethylated 4-4-6 triglucan and the like with a solvent to produce an ink-like dispersion which is applied by a printing technique onto insulating layer 72 and dried.

Transparent electrode 74 can be similarly produced by dispersing an ITO (indium tin oxide) powder in a binder and dissolving with a solvent to produce an ink-like dispersion which is applied onto light emitting EL layer 73 and then dried. Alternatively, as transparent electrode 74 a transparent electrode film comprising a polyester film having ITO vapor-deposited thereon may be used.

Electrode leads 75 and 76 are attached to and extend from common back electrode 71 and two transparent electrodes 74, respectively. The bulk element is packaged with a film having a high moisture-proofing property (not shown) to complete an EL element.

Referring to FIG. 8, a step of forming electrode leads 75 and 76 will be illustrated hereafter. FIG. 8 is a plane view of the common back electrode 71 of the double side light emitting EL lamp shown in FIG. 7.

Figure 9:
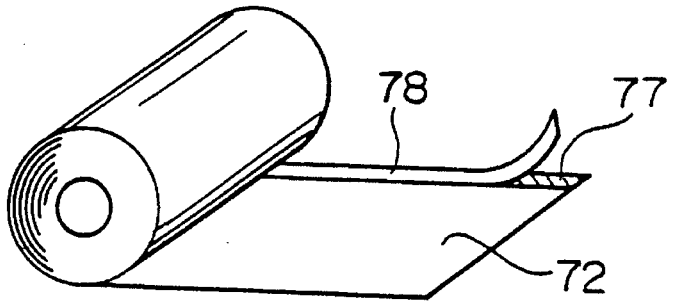
FIG. 9 is a perspective view of a roll for use in production of the common electrodes of the double side light emitting EL elements according to an embodiment of the present invention.
Figure 10:
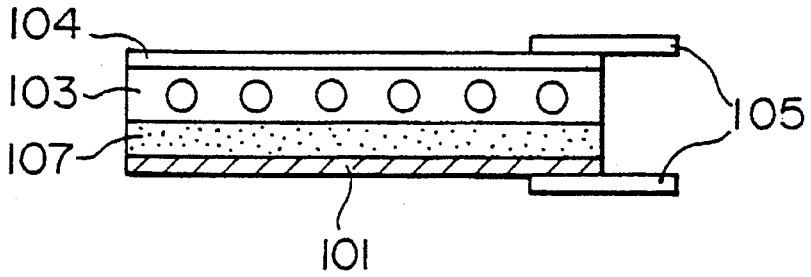
FIG. 10 PRIOR ART
FIG. 10 is a schematic cross-sectional view of the EL lamp according to the prior art.

At the time of he formation of insulating layer 72 which comprises the aluminum oxide produced by anodizing an aluminum foil for the common back electrode, as can be seen from FIG. 9, one of the surfaces of the aluminum foil is applied with mask 78 covering shadowed area 77 shown in FIG. 8 prior to anodic oxidation. After the anodic oxidation, mask 78 is removed exposing the unanodized bare aluminum foil in the shadowed area 77. Onto the area 77 is adhered electrode lead 75 extending therefrom as a common lead for the back electrode.

After a combination of light emitting layer 73 and transparent electrode 74 has been produced on each of the opposing surfaces of the foil, each electrode lead 76 is adhered to busbar 79 provided on corresponding transparent electrode 74.

In the double side light emitting EL lamp manufactured the Example of the present invention as described above, for example, common back electrode 71 comprised an aluminum foil having a thickness of 80 μm, insulating aluminum oxide ($Al_2O_3$) layers 72 formed on the surfaces thereof were at most of a thickness of about 1 μm even in total, light emitting layers 73 were of a thickness of 50 μm×2 in total and transparent electrodes 74 were of a thickness of 10×2, resulting in the whole thickness of 201 μm.

Figure 11:
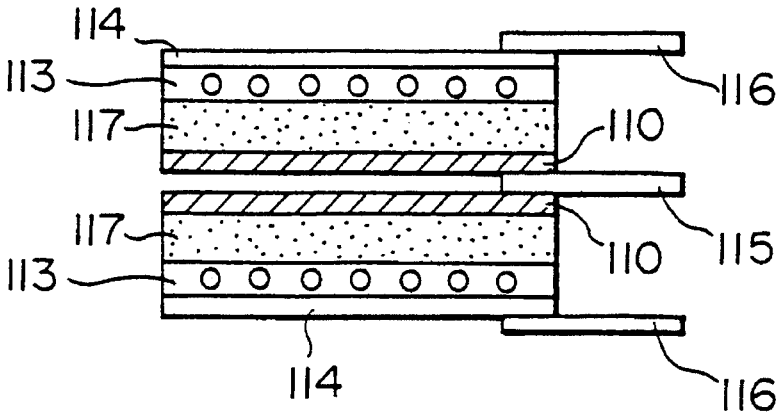
FIG. 11 PRIOR ART
FIG. 11 is a schematic cross-sectional view of the double side light emitting EL lamp according to the prior art.

In contrast, on the basis of the same standard, the prior art double side light emitting EL lamp as shown in FIG. 11 comprises back electrodes 110 of 80 μm×2, insulating layers 117 of 40 μm×2, light emitting layers 113 of 50 μm×2, and transparent electrodes 114 of 10 μm×2, resulting in the whole thickness of 360 μm. Therefore, the embodiment of the present invention allowed a great reduction in the thickness.

In the embodiment of the present invention as described above, the materials for common back electrodes have been aluminum foil, but are not limited thereto, and other conductive materials may be employed. Furthermore, the process for anodic oxidation and the treatments of aluminum foil are not limited to, but performed under other conditions than those disclosed in the Examples to obtain the identical effects to those obtained therein.

As explained above, the present invention enables EL elements having a higher breakdown strength and a higher luminescence efficiency to be manufactured in simple steps by forming anodized oxide films, especially non-porous dense crystalline aluminum oxide films on the surfaces of aluminum foils as insulating films. Moreover, the luminescence irregularity can be reduced. Furthermore, El elements having a higher luminescence efficiency can be provided by specularly polishing the surfaces of aluminum foils and thereafter conducting anodic oxidation to form the aluminum oxide films.

The use of the opposing surfaces of a conductive layer as a common back electrode avoids the need of superimposing two back electrodes so that the whole double side light emitting EL element can be made thinner allowing the production process to be simplified.

In addition, the technique that the insulating layers of a double side light emitting EL lamp are made by anodizing the back electrode enables the insulating layers to be made thinner so that the EL lamp itself can be thinner as a whole.

The present invention has been disclosed with reference to preferred embodiments, but is not limited thereto. For example, besides light sources of back lights for LCD devices, EL elements for use in various applications can be similarly manufactured. For example, aluminum plates can be substituted for aluminum foils. As a transparent electrode, a transparent electrode film comprising a polyester film having ITO vapor-deposited thereon instead of powdery ITO coated may be used. It will be obvious for those skilled in the art that other various alterations and modifications can be made within the scope of the present invention.

What is claimed is:

1. A process for manufacturing an EL lamp comprising the steps of:

anodizing an aluminum foil in a substantially neutral electrolyte solution to form a non-porous aluminum oxide layer, forming a light emitting EL layer directly on said anodized aluminum foil, and forming a transparent electrode layer on said light emitting EL layer.

2. A process for manufacturing an EL lamp comprising the steps of:

immersing an aluminum foil in a pure water heated at a temperature of at least 50° C.;

anodizing said aluminum foil in a substantially neutral electrolyte solution to produce a barrier type film of dense non-porous aluminum oxide on the surface of said foil, forming a light emitting EL layer directly on said barrier type film, and forming a transparent electrode layer on said light emitting EL layer.

3. The process of manufacturing an EL lamp according to claim 2, in which at least one of phosphoric acid and phosphates is added to said pure water.

4. The process of manufacturing an EL lamp according to claim 2, in which an activator is added to said pure water.

5. A process for manufacturing an EL lamp comprising the steps of:

polishing specularly the surface of an aluminum foil, forming a non-porous anodized oxide film on said specularly polished surface of said aluminum foil, forming directly on said anodized oxide film a light emitting EL layer, and forming a transparent electrode on said light emitting EL layer.

6. The process of manufacturing an EL lamp according to claim 5, in which said specularly polishing step comprises an electrolytic polishing step.

7. The process of manufacturing an EL lamp according to claim 6, in which said anodized oxide film forming step is conducted together with said electrolytic polishing step.

8. The process of manufacturing an EL lamp according to claim 5, in which said specularly polishing step comprises a chemically polishing step.

9. The process of manufacturing an EL lamp according to claim 5, in which said specularly polishing step comprises a mechanically grinding step.

10. The process of manufacturing an EL lamp according to claim 5, in which said anodized oxide film forming step comprises a step of anodizing said specularly polished aluminum foil in an electrolyte solution to produce an aluminum oxide film on the surface of said aluminum foil.

11. The process of manufacturing an EL lamp according to claim 10, in which said anodized oxide film has a thickness of 0.01 to 0.45 μm.

12. The process of manufacturing an EL lamp according to claim 5, in which said anodized oxide film forming step comprises a step of anodizing said specularly polished aluminum foil in a substantially neutral electrolyte solution to produce a dense non-porous aluminum oxide film of the barrier type on the surface of said foil.

13. The process of manufacturing an EL lamp according to claim 6, in which said anodized oxide film forming step comprises a step of anodizing said specularly polished aluminum foil in a substantially neutral electrolyte solution to produce a dense non-porous aluminum oxide film of the barrier type on the surface of said foil.

14. The process of manufacturing an EL lamp according to claim 8, in which said anodized oxide film forming step comprises a step of anodizing said specularly polished aluminum foil in a substantially neutral electrolyte solution to produce a dense non-porous aluminum oxide film of the barrier type on the surface of said foil.

15. The process of manufacturing an EL lamp according to claim 5, in which said anodized oxide film forming step comprises first immersing said specularly polished aluminum foil in water at a temperature of at least 50°, and then anodizing said foil in a substantially neutral electrolyte solution to produce a dense non-porous aluminum oxide film of the barrier type on the surface of said foil.

16. The process of manufacturing an EL lamp according to claim 6, in which said anodized oxide film forming step comprises first immersing said specularly polished aluminum foil in water at a temperature of at least 50°, and then anodizing said foil in a substantially neutral electrolyte solution to produce a dense non-porous aluminum oxide film of the barrier type on the surface of said foil.

17. The process of manufacturing an EL lamp according to claim 8, in which said anodized oxide film forming step comprises first immersing said specularly polished aluminum foil in water at a temperature of at least 50°, and then anodizing said foil in a substantially neutral electrolyte solution to produce a dense non-porous aluminum oxide film of the barrier type on the surface of said foil.

18. The process of manufacturing an EL lamp according to claim 5, in which said anodized oxide film forming step comprises first anodizing said specularly polished aluminum foil in a substantially neutral electrolyte solution to produce a dense non-porous aluminum oxide film of the barrier type on the surface thereof, and then immersing said foil in water at a temperature of at least 50°.

19. The process of manufacturing an EL lamp according to claim 6, in which said anodized oxide film forming step comprises first anodizing said specularly polished aluminum foil in a substantially neutral electrolyte solution to produce a dense non-porous aluminum oxide film of the barrier type on the surface thereof, and then immersing said foil in water at a temperature of at least 50°.

20. The process of manufacturing an EL lamp according to claim 8, in which said anodized oxide film forming step comprises first anodizing said specularly polished aluminum foil in a substantially neutral electrolyte solution to produce a dense non-porous aluminum oxide film of the barrier type on the surface thereof, and then immersing said foil in water at a temperature of at least 50°.

21. A process for manufacturing a double side light emitting EL lamp, comprising the steps of:

forming non-porous insulating layers on the opposing surfaces of a conductive material, and forming light emitting EL layers on said insulating layers, and forming transparent electrodes on said light emitting EL layers.

22. The process of manufacturing a double side light emitting EL lamp according to claim 21, in which said insulating layer forming step comprises anodizing both opposing surfaces of an aluminum foil as said conductive material, to produce a barrier type aluminum oxide film.

23. The process of manufacturing a double side light emitting EL lamp according to claim 22, in which said insulating layer forming step comprises masking a partial area of the surfaces of said aluminum foil during anodic oxidation to expose said aluminum foil in said area, and attaching an electrode lead to and extending from said exposed aluminum foil in said area.

24. The process of manufacturing an EL lamp according to claim 4, in which the activator is selected from the group consisting of Mn, Eu, Tb, Nd, Dy and combinations thereof.

* * * * *